United States Patent [19]

Takeyama et al.

[11] Patent Number: 4,577,850

[45] Date of Patent: Mar. 25, 1986

[54] AUTOMATIC PAPER FEEDER FOR REPRODUCING MACHINE

[75] Inventors: Kokichi Takeyama; Kiyoshi Sugawara; Yasuyuki Fukagawa, all of Kanagawa, Japan

[73] Assignee: Fuji Xerox Co., Ltd., Tokyo, Japan

[21] Appl. No.: 613,009

[22] Filed: May 21, 1984

Related U.S. Application Data

[63] Continuation of Ser. No. 317,734, Nov. 3, 1981, abandoned.

[51] Int. Cl.[4] ..... B65H 3/30

[52] U.S. Cl. ..... 271/22; 271/127; 271/164

[58] Field of Search ..... 271/22, 117, 126, 127, 271/162, 164

[56] References Cited

U.S. PATENT DOCUMENTS

| | | | |
|---|---|---|---|
| 3,563,535 | 2/1971 | Vitu | 271/164 X |
| 4,219,192 | 8/1980 | Burke | 271/164 X |
| 4,221,375 | 9/1980 | Morrison | 271/9 X |
| 4,280,692 | 7/1981 | Hutchinson | 271/164 X |
| 4,387,889 | 6/1983 | Koyama | 271/162 X |
| 4,444,386 | 4/1984 | Murata | 271/127 |

*Primary Examiner*—Richard A. Schacher

*Attorney, Agent, or Firm*—Sughrue, Mion, Zinn, Macpeak, and Seas

[57] ABSTRACT

A cam and abutment surface cooperate to urge apart a paper stack and roller as a paper cassette is inserted into the feeding station of a reproducing machine, thereby providing temporary clearance for the paper stack to pass by the roller during insertion.

5 Claims, 3 Drawing Figures

AUTOMATIC PAPER FEEDER FOR REPRODUCING MACHINE

This application is a continuation of application Ser. No. 317,734, filed Nov. 3, 1981 now abandoned.

BACKGROUND OF THE INVENTION

This invention concerns an automatic paper feeder for reproducing machines.

The paper feeder for a conventional reproducing machine is arranged as shown in FIG. 1, wherein paper sheets b contained in a cassette a are sent one by one into a sending passage g leading to the reproducing apparatus (not shown). The sheets are supplied by way of a feed roll d while being limited to one sheet at a time by a snubber c. The paper sheets b in the cassette a are supported on a bottom plate f upwardly biased by a spring e, and the upper side of the plate is pressed against the feed roll d.

Consequently, when the cassette a is inserted into the reproducing machine, a portion of the high end of the stack of paper sheets b contained in the cassette a is higher than the lower surface of the feed roll d.

Since the cassette a is inserted in the state described above into the reproducing machine in a conventional automatic paper feeder, the top front end of the stack of paper sheets b is intensely abutted against the feed roll d upon insertion to deform the top front end of the paper sheets b, thereby causing problems in the subsequent feeding operation.

SUMMARY OF THE INVENTION

This invention has been made in view of the foregoing problems, and the invention provides an automatic paper feeder for a reproducing machine capable of smooth automatic feeding, wherein the top front end of the stack of paper sheets in the cassette is moved downwardly upon insertion of the cassette into the reproducing machine, so that the upper surface of the top end of the paper sheets can be prevented from abutting against the feed roll and the deformation of the paper in the cassette can be prevented.

BRIEF DESCRIPTION OF THE INVENTION

DETAILED DESCRIPTION OF THE INVENTION

Figure 1:
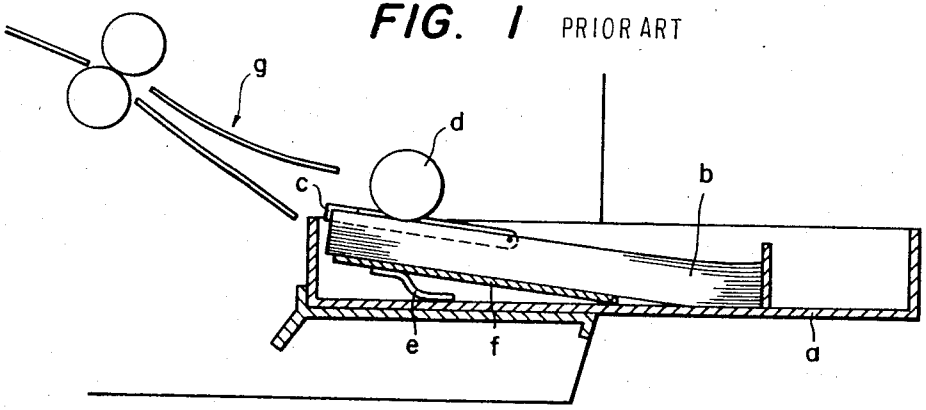
FIG. 1 PRIOR ART
FIG. 1 is a view showing the state wherein a cassette has been inserted in a conventional paper feeder.
Figure 2:
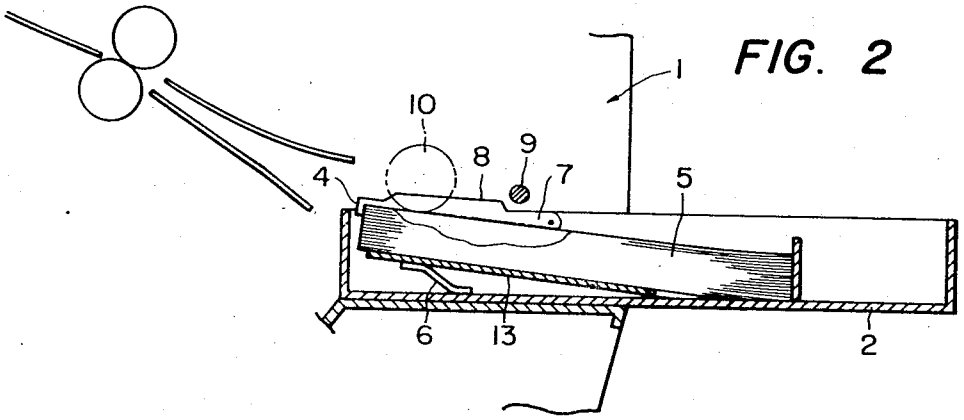
FIG. 2 is a view showing the state wherein a cassette has been inserted in a paper feeder according to an embodiment of this invention.
Figure 3:
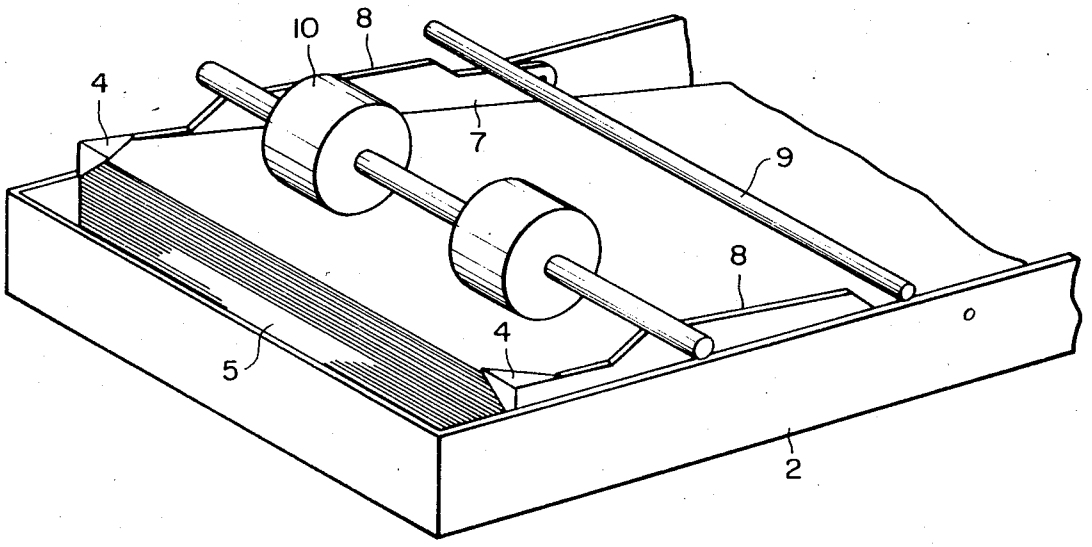
FIG. 3 is a perspective view of the cassette shown in FIG. 2 showing the rolls 9 and 10 of the paper feeder.

The construction of this invention will now be described with reference to an embodiment shown in FIG. 2 and FIG. 3.

In the drawings, 1 represents an automatic paper feeder for a reproducing machine, 2 is a cassette to be inserted into the automatic paper feeder 1, 3 is a bottom plate and 4 is a snubber. Paper sheets 5 are loaded on the bottom 4, 6 is a spring for urging the bottom plate 3 upwardly. The snubber 4 is provided at the top end of the arm 7 whose one end is pivotted on the side wall of the cassette 2, and the snubber presses down on both corners of the paper sheets 5 by its own weight.

An upwardly protruded cam 8 is formed on the upper side of the arm 7 of the snubber 4. On the other hand, a roll 9 is disposed at the insertion section of the cassette 2 in the automatic paper feeder 1 for abutting against the cam 8 upon insertion of the cassette 2, to thereby downwardly move the arm 7. The positional relationship between the cam 8 and the roll 9 is such that when the cassette 2 is inserted into the automatic power feeder 1 to an extent where the top end of the paper sheets 5 is just before the feed roll 10, the cam 8 abuts against the roll 9 to downwardly move the arm 7, and when the top end of the paper sheets 5 has passed through below the feed roll 10 the abutment is disengaged.

With the construction described above, the top end of the paper sheets 5 moves downwardly, due to the abutment between the cam 8 and the roll 9 upon inserted of the cassette 2, and no longer abuts against the feed roll 6, whereby deformation of the paper sheets in the cassette 2 can be prevented to enable smooth automatic feeding.

It will be appreciated that the same effect should be achieved by urging the roller 10 upwardly rather than the paper downwardly. I.e., the roller 10 could be raised together with the roll 9 and the tray 3 could remain fixed. Alternatively, both the tray and the roller 10 could be moved. Also, obviously, the cam 8 need not press downwardly on the paper through the arm 7 and snubber 4, but could instead be coupled directly to the plate 3, or the cam 8 could be fixedly mounted on the machine with a roll 9 mounted on the cassette and being vertically movable.

What is claimed is:

1. In an automatic paper feeder or a reproducing machine, of the type comprising a cassette insertable into a paper feeding station, said paper feeding station including a roller for feeding paper from said cassette into said reproducing machine and said cassette including means for supporting said paper, the improvement comprising:

separating means for automatically providing a clearance between said roller and said paper during insertion of said cassette into said paper feeding station by automatically urging said paper away from said roller in response to movement of said cassette into said station.

2. The improvement as claimed in claim 1 wherein said separating means comprises a cam mounted on one of said reproducing machine and said cassette, and an abutment member mounted on the other of said reproducing machine and cassette one of said cam and abutment member being moveable and engageable with said paper, said cam and abutment member engaging one another during insertion of said cassette to move said paper to thereby provide said clearance.

3. The improvement as claim 2, wherein said cam is movably mounted on said casssette and is engageable with said paper to urge said paper away from said roller during insertion of said cassette.

4. The improvement as claimed in claim 3, wherein said cassette tray comprises a plate for resiliently supporting said paper and an arm pivotally mounted to said cassette and having a portion resting on an upper surface of said paper, and wherein said cam is integrally formed on said arm and is urged downwardly by said abutment means during insertion of said cassette.

5. The improvement as claimed in claim 4, wherein said arm comprises a snubber for limiting the amount of paper fed during a paper feeding operation.

* * * * *